US007896101B2

(12) United States Patent
Wakabayashi et al.

(10) Patent No.: US 7,896,101 B2
(45) Date of Patent: Mar. 1, 2011

(54) PNEUMATICALLY OPERATED POWER TOOL HAVING MECHANISM FOR CHANGING COMPRESSED AIR PRESSURE

(75) Inventors: Michio Wakabayashi, Hitachinaka (JP); Takashi Mori, Hitachinaka (JP); Shouichi Hirai, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 377 days.

(21) Appl. No.: 12/027,376

(22) Filed: Feb. 7, 2008

(65) Prior Publication Data

US 2008/0185058 A1 Aug. 7, 2008

(30) Foreign Application Priority Data

Feb. 7, 2007 (JP) ..... P2007-027421

(51) Int. Cl.
*B25C 1/04* (2006.01)

(52) U.S. Cl. ..... 173/169; 227/130; 137/505.15

(58) Field of Classification Search ..... 137/505.14, 137/505.15, 505.18; 227/130; 81/430, 433; 173/168, 169
See application file for complete search history.

(56) References Cited

U.S. PATENT DOCUMENTS

| | | | | |
|---|---|---|---|---|
| 7,093,743 | B2 * | 8/2006 | Oouchi et al. | 227/130 |
| 7,255,257 | B2 * | 8/2007 | Oouchi et al. | 227/130 |
| 2005/0247750 | A1 * | 11/2005 | Burkholder et al. | 227/130 |

FOREIGN PATENT DOCUMENTS

| | | |
|---|---|---|
| CN | 1396855 | 2/2003 |
| JP | 11-300639 | 11/1999 |
| JP | 2005-118895 | 5/2005 |
| WO | WO 01/54865 | 8/2001 |

* cited by examiner

*Primary Examiner* — John Rivell
*Assistant Examiner* — Kevin Murphy
(74) *Attorney, Agent, or Firm* — Antonelli, Terry, Stout & Kraus, LLP.

(57) ABSTRACT

A pneumatically operated power tool includes an outer frame, a driving components, a pressure reduction valve, and a switching valve. The outer frame has a compressed air intake portion and defines therein a compressed air chamber. The driving components are disposed in the outer frame and are driven by a compressed air in the compressed air chamber. The pressure reduction valve defines a pressure receiving space and allows a compressed air to flow from the air intake portion to the compressed air chamber and to the pressure receiving space. The switching valve is movable between a first position where the compressed air flows from the compressed air intake portion to the pressure receiving space, and a second position where a communication between the compressed air intake portion and the pressure receiving space is blocked. The pressure reduction valve is configured to set a compressed air pressure in the compressed air chamber to a first pressure level if the switching valve is located at the first position and to set the compressed air pressure to a second pressure level lower than the first pressure level if the switching valve is located at the second position.

8 Claims, 5 Drawing Sheets

PNEUMATICALLY OPERATED POWER TOOL HAVING MECHANISM FOR CHANGING COMPRESSED AIR PRESSURE

BACKGROUND OF THE INVENTION

The present invention relates to a pneumatically operated power tool, such as a pneumatically operated screw driver driven by compressed air to perform a prescribed operation.

Pneumatically operated screw drivers are well known in the art as a type of pneumatically operated power tool. In the examples of Japanese Patent Application Publications Nos. H11-300639 and 2005-118895, the screw driver includes a rotating body driven to rotate by a pneumatic motor, a rotation slide member accommodated in the rotating body so as to be capable of sliding up and down therein, a driver bit mounted on the lower end of the rotation slide member, and a piston formed circumferentially around the lower end of the rotation slide member and fitted into a cylinder so as to be capable of moving vertically therein.

With this type of screw driver, the rotation of the pneumatic motor is transmitted to the driver bit through the rotation slide member, and air compression applied to the piston moves the rotation slide member within the cylinder, thereby applying rotational and axial movement to the driver bit mounted on the rotation slide member in order to drive a screw into a workpiece. After the screw driving operation is completed, compressed air accumulated in a return chamber returns the rotation slide member and the driver bit to their initial states.

Although this screw driver is applied to applications for fastening a gypsum plaster board, for example, to a base member formed of wood, a steel plate, or the like, the amount of energy required for driving the screw in the case of the steel plate varies considerably depending on the thickness and hardness of the steel plate. If the steel plate is considerably thick or hard, the screw driver cannot drive the screw into the plate, as the tip of the screw does not penetrate the plate in some cases. Hence, the pressure of the supplied compressed air is set sufficiently high to produce a large driving force for penetrating the steel plate. However, since this driving force is too large when driving a screw into a thinner steel plate, the screw will penetrate the steel plate too far so that the gypsum plaster board or the like is not securely fastened. Hence, this conventional screw driver requires means for adjusting the force of the compressed air to suit the type of base member.

Conventionally, a pressure reduction valve has been used to change the force of compressed air. Normally, the pressure reduction valve is mounted on or disposed near the compressor at a position separated from the working position. Therefore, the operator of the screw driver must walk to the location, in which the compressor is positioned, to change the pressure reduction valve when the type of base member requires a different driving force, resulting in cumbersome work for the operator.

Hence, some screw drivers that are now available commercially incorporate a pressure changing mechanism having a pressure reduction valve in the body of the screw driver.

SUMMARY OF THE INVENTION

However, normally the pressure changing mechanism provided in these conventional screw drivers cannot be changed in steps, but are configured of an adjustment knob that the operator rotates to change the pressure. Consequently, the operator cannot instantaneously switch the pressure changing mechanism to a desired pressure, resulting in poor operability and user-friendliness for situations in which work conditions change frequently.

Therefore, it is an object of the present invention to provide a pneumatically operated power tool having improved operability by allowing the operator to switch between desired pressures easily and instantaneously.

In order to attain the above and other objects, the present invention provides a pneumatically operated power tool including an outer frame, driving components, a pressure reduction valve, and a switching valve. The outer frame has a compressed air intake portion and defines therein a compressed air chamber. The driving components are disposed in the outer frame and are driven by a compressed air in the compressed air chamber. The pressure reduction valve defines a pressure receiving space and allows a compressed air to flow from the air intake portion to the compressed air chamber and to the pressure receiving space. The switching valve is movable between a first position where the compressed air flows from the compressed air intake portion to the pressure receiving space, and a second position where a communication between the compressed air intake portion and the pressure receiving space is blocked. The pressure reduction valve is configured to set a compressed air pressure in the compressed air chamber to a first pressure level if the switching valve is located at the first position and to set the compressed air pressure to a second pressure level lower than the first pressure level if the switching valve is located at the second position.

According to another aspect, the invention also provides a pressure changing mechanism for use in a pneumatically operated power tool including an outer frame having a compressed air intake portion and defining therein a compressed air chamber, and driving components disposed in the outer frame and driven by a compressed air in the compressed air chamber. The pressure changing mechanism includes a pressure reduction valve and a switching valve. The pressure reduction valve defines a pressure receiving space and allows a compressed air to flow from the air intake portion to the compressed air chamber and to the pressure receiving space. The switching valve is movable between a first position where the compressed air flows from the compressed air intake portion to the pressure receiving space, and a second position where a communication between the compressed air intake portion and the pressure receiving space is blocked. The pressure reduction valve is configured to set a compressed air pressure in the compressed air chamber to a first pressure level if the switching valve is located at the first position and to set the compressed air pressure to a second pressure level lower than the first pressure level if the switching valve is located at the second position.

DESCRIPTION OF THE PREFERRED EMBODIMENTS

A pneumatically operated power tool according to a first embodiment of the present invention will be described with reference to FIGS. 1 through 3. The first embodiment pertains to a screw driver.

Figure 1:
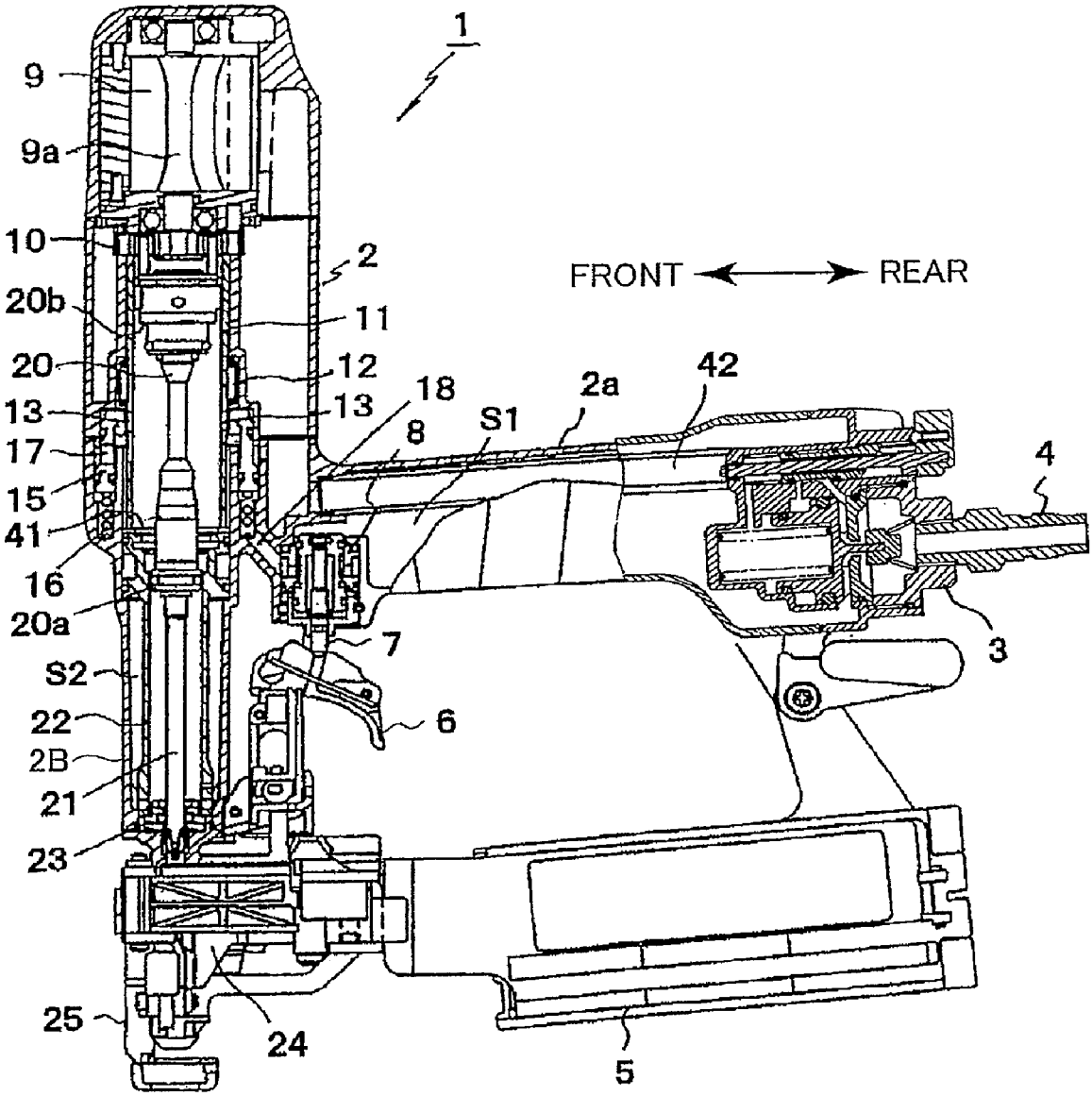
FIG. 1 is a cross-sectional view of a pneumatically operated screw driver according to a first embodiment of the present invention.

FIG. 1 is a cross-sectional view of the pneumatically operated screw driver 1 according to the first embodiment. The screw driver 1 includes a having a T-shape in a side view. Inside the outer frame 2, a compressed air chamber S1 is defined in which a compressed air supplied from an external compressor (not shown) is accumulated. The outer frame 2 also has a handle 2*a*. A pressure changing mechanism 3 is connected to a rear end of the handle 2*a*. An air plug 4 is provided on the rear end of the pressure changing mechanism 3 for connecting an air hose (not shown) leading from the external compressor (not shown). The handle 2*a* is formed with a discharge path 42 for discharging compressed air from the outer frame 2.

A magazine 5 capable of accommodating a plurality of screws (not shown) linked to one another is mounted on the lower end of the outer frame 2. The screw driver 1 also includes an operation valve 8 and a trigger 6. The operation valve is provided in the region where the handle 2*a* connects to the outer frame 2 and has a plunger 7. The trigger 6 moves the plunger 7 up and down.

A pneumatic motor 9 having a rotor 9*a* is accommodated in a top section of the outer frame 2. A planetary gear mechanism 10 is disposed beneath the pneumatic motor 9. A cylindrical rotary member 11 having a closed bottom is rotatably supported in the outer frame 2 by a bearing 12. The rotary member 11 is connected to the rotor 9*a* of the pneumatic motor 9 via the planetary gear mechanism 10. A rotation of the rotor 9*a* is decelerated by the planetary gear mechanism 10 and transmitted to the rotary member 11. A damper plate 41 is provided below the rotary member 11 to close the bottom of the rotary member 11.

A plurality of air holes 13 is formed in a side wall of the rotary member 11 near a axial center of the rotary member 11. A main valve 15 having a cylindrical shape and being capable of moving in a axial direction of the rotary member 11 is disposed in a groove formed in the outer frame 2 at a position corresponding to the air holes 13. The main valve 15 is formed with an air hole 17. A spring 16 urges the main valve 15 upward.

An air hole 18 in communication with the operation valve 8 is formed below the groove in the outer frame 2.

A rotation slide member 20 is fitted into the rotary member 11 so as to be axially movable relative to the rotary member 11 in the axial direction. A raised portion provided on the periphery of the rotation slide member 20 is fitted into a recessed portion formed in the inner peripheral surface of the rotary member 11. Thus, the rotation slide member 20 is rotatable together with the rotary member 11. A piston 20*a* is provided around the lower end of the rotation slide member 20. The rotation slide member 20 defines a blocking surface 20*b* for sealing a fluid communication between the inside of the rotary member 11 and the inside of the pneumatic motor 9. A driver bit 21 is provided on the bottom end of the rotation slide member 20 and extends downward therefrom.

A cylinder 22 formed with an opening in the top surface thereof extends along the axial direction in the lower section of the outer frame 2. The piston 20*a* fits into the cylinder 22 so as to be capable of sliding in the axial direction along the inner peripheral surface of the cylinder 22. A return chamber S2 is defined by the cylinder 22 and a lower outer frame part 2B. A piston damper 23 is provided in the bottom of the cylinder 22.

A screw feeder 24 is provided on the bottom of the outer frame 2 for automatically supplying the screws accommodated in the magazine 5. A push lever 25 is provided below the screw feeder 24, with one end extending near the trigger 6.

Next, the operations of the screw driver 1 having the above structure will be described.

Compressed air is introduced into the groove below the main valve 15 through the compressed air chamber S1, operation valve 8, and air hole 18. At this time, the air pressure and the biasing force of the spring 16 push the main valve 15 upward, closing off the air holes 13 that provide the fluid communication between the compressed air chamber S1 and the rotary member 11 and sealing the supply of compressed air into the rotary member 11 and toward the pneumatic motor 9.

With the screw driver 1 in this state, the operator pushes the push lever 25 against a workpiece such as a wood or a gypsum plaster board, and pulls the trigger 6 to actuate the operation valve 8. At this time, the compressed air beneath the main valve 15 is discharged from the screw driver 1 through the air hole 18 and operation valve 8. Since air pressure is being applied to the top surface of the main valve 15 near the outer periphery thereof, the main valve 15 is pressed downward against the biasing force of the spring 16. Hence, compressed air flows into the rotary member 11, applying air pressure to the top surface of the piston 20*a*. Consequently, the rotation slide member 20 is pressed downward together with the driver bit 21, allowing compressed air to be supplied to the pneumatic motor 9 for driving the same.

As described above, upon driving the pneumatic motor 9, the planetary gear mechanism 10 transmits the rotation of the rotor 9*a* to the rotary member 11 at a reduced ratio, thereby rotating the rotary member 11 and rotation slide member 20. Therefore, the driver bit 21 mounted on the rotation slide member 20 rotates while being pushed downward in order to drive a screw into the workpiece (not shown).

When the driver bit 21 reaches the end of its downward drop at which the screw driving operation is complete, the piston 20*a* of the rotation slide member 20 collides with the piston damper 23, halting the drop of the rotation slide member 20 and driver bit 21. At the same time, the air blocking surface 20*b* of the rotation slide member 20 contacts the damper plate 41, thereby sealing the supply of compressed air to the pneumatic motor 9. Since the pneumatic motor 9 halts operations at this time, the rotary member 11, rotation slide member 20, and driver bit 21 cease to rotate. At this time, compressed air is collected in the return chamber S2.

After the operator subsequently releases the push lever 25 and the trigger 6 so that the operation valve 8 returns to its initial position, compressed air and the biasing force of the spring 16 push the main valve 15 upward. The compressed air flows into the groove beneath the main valve 15 from the compressed air chamber S1 via the operation valve 8 and air hole 18. At this time, the fluid communication between the compressed air chamber S1 and rotary member 11 is sealed, while the air hole 17 formed in the main valve 15 is in communication with the discharge path 42 through an air passage (not shown). Accordingly, compressed air in the rotary member 11 is discharged from the outer frame 2. Since the compressed air accumulated in the return chamber S2 is supplied into the cylinder 22, the bottom surface of the piston 20*a* receives the force of this compressed air so that the rotation slide member 20 rises together with the driver bit 21 and returns to its initial position. At the same time, the screw feeder 24 feeds the next screw from the magazine 5 to a position aligned with the axis of the driver bit 21 and subsequently returns to its initial state.

Next, the pressure changing mechanism 3 provided in the screw driver 1 according to the first embodiment will be described in greater detail with reference to FIGS. 2 and 3.

Figure 2:
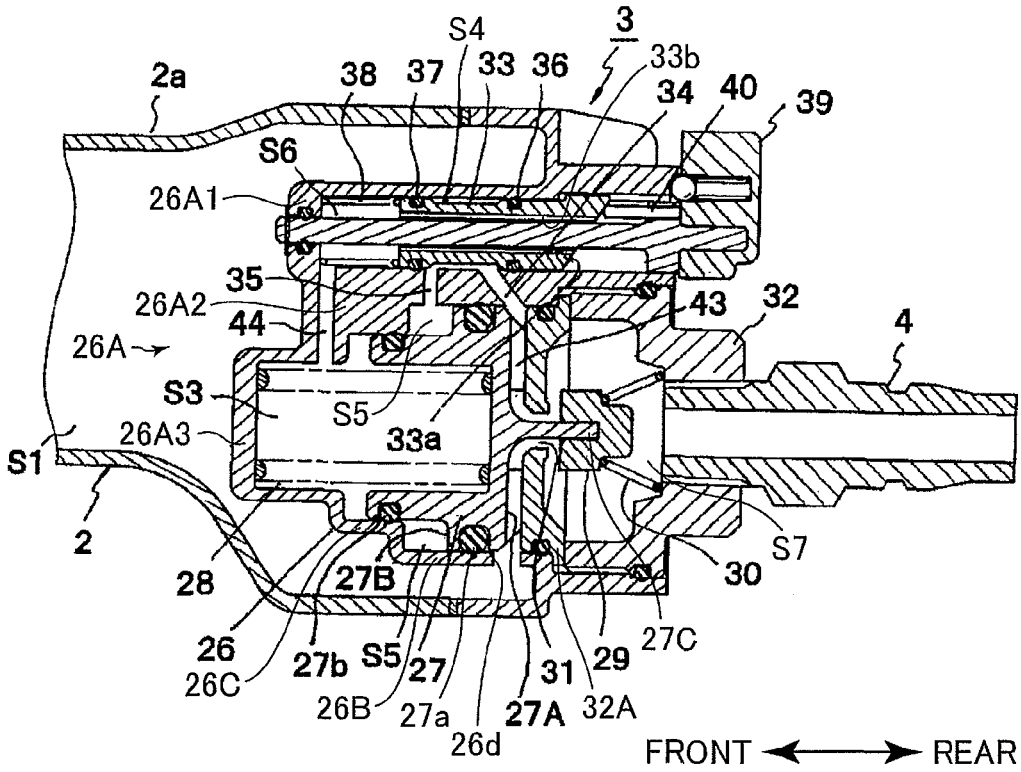
FIG. 2 is a cross-sectional view of a pressure changing mechanism provided in the screw driver according to the first embodiment when a switching valve is in a first position.
Figure 3:
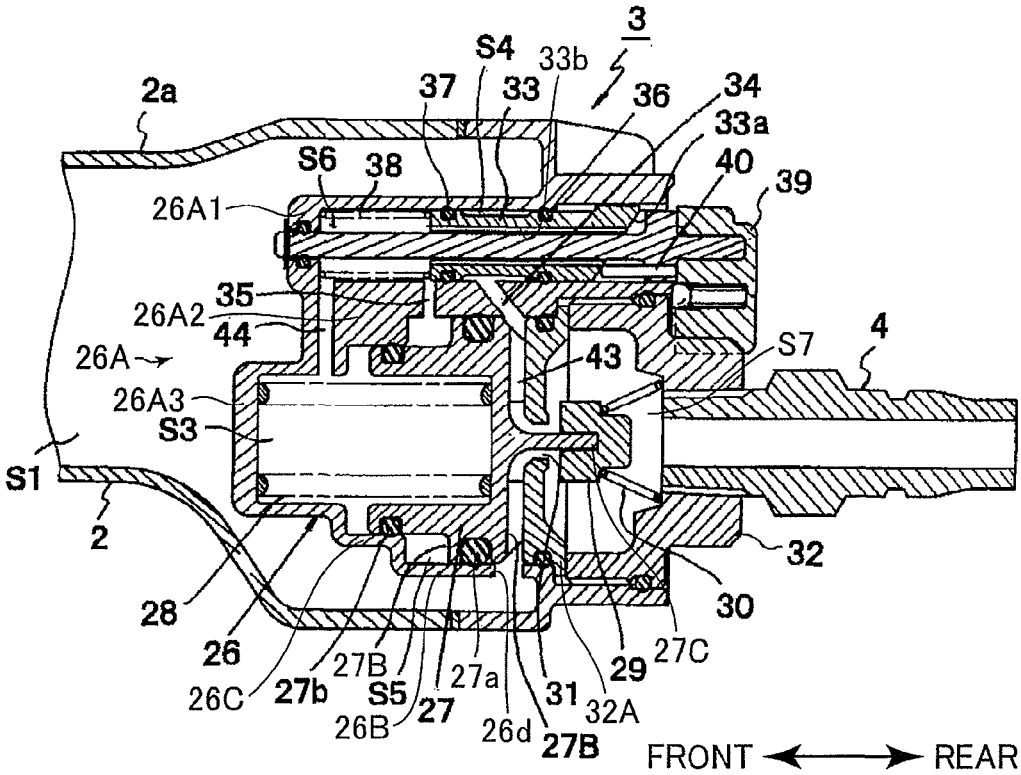
FIG. 3 is a cross-sectional view of a pressure changing mechanism provided in the compressed air screwdriver according to the first embodiment when the switching valve is in a second position.

FIGS. 2 and 3 are cross-sectional views of the pressure changing mechanism 3. The pressure changing mechanism 3 has a pressure reduction valve 26 disposed between the air plug 4 and the compressed air chamber S1. The pressure reduction valve 26 mainly includes a main body 26A, a piston 27, a first spring 28, a valve head 29, a second spring 30, an end cap 32, and a holder 32A. The main body 26A further includes a first section 26A1, a second section 26A2, and a third section 26A3. The first section 26A1 is cylindrical in shape with a closed bottom and defines a valve chamber S6 extending in the front-to-rear direction therein. The second section 26A2 is formed with a first through-hole 34, a second through-hole 35, and an air hole 44. The third section 26A3 is also cylindrical in shape with a closed bottom and is formed with a communication hole 26*d* communicating with the compressed air chamber S1.

The piston 27 is disposed inside the third section 26A3 and, together with the third section 26A3, defines a spring chamber S3. The piston 27 also has a first seal member 27*a* and a second seal member 27*b*. The first seal 27*a* has an outer diameter larger than that of the second seal 27*b*. Both the first and second seal members 27*a* and 27*b* are configured of an O-ring. The third section 26A3 also includes a first wall 26B, and a second wall 26C. The first wall 26B has an inner diameter, which is substantially equal to the outer diameter of the first seal member 27*a*, while the second wall 26C has an inner diameter, which is substantially equal to the outer diameter of the second seal member 27*b*. Thus, the first seal member 27*a* slidingly moves along the first wall 26B, while the second seal member 27*b* slidingly moves along the second wall 26C. Accordingly, the piston 7 is slidingly movable relative to the third section 26A3. The first seal member 27*a*, second seal member 27*b*, first wall 26B, second wall 26C and piston 27 define a seal space S5.

The piston 27 also has a first pressure receiving surface 27A, formed on the rear side, in confrontation with the holder 32A, and a second pressure receiving surface 27B formed as a step part between the first seal member 27*a* and second seal member 27*b* and facing the seal space S5. A valve stem 27C extends from the first pressure receiving surface 27A. The first spring 28 is interposed between a bottom of the main body 26A and the piston 27 for urging the piston 27 toward the air plug 4.

The holder 32A is disposed on the rear side of the piston 27 for sealing fluid communication between the compressed air chamber S1 and a compressed air injection chamber S7 defined by the end cap 32 and the holder 32A. A through-hole 31 is formed in the holder 32A for allowing penetration of the valve stem 27C. Accordingly, an annular space is formed between the valve stem 27C and the through-hole 31. The valve head 29 is fixed to a distal end of the valve stem 27C and moves together with the piston 27. The valve head 29 can contact the holder 32A to close the through-hole 31 when the piston 27 moves forward.

The second spring 30 is interposed between the valve head 29 and end cap 32 for urging the valve head 29 toward the piston 27. Hence, the valve head 29 is supported by the spring 30 while being allowed to move. The end cap 32 is disposed at the open edge of the third section 26A3. The holder 32A and the end cap 32 define a compressed air injection chamber S7 in communication with the air plug 4. Further, the first pressure receiving surface 27A is formed with diametrically extending cruciform grooves 43 communicating with the compressed air chamber S1 via the communication hole 26*d*. The spring chamber S3 is constantly in fluid communication with external air through the air hole 44.

A switching valve 33 is slidably movably fitted into the valve chamber S6. A space S4 is defined by the first section 26A1 and the switching valve 33. When the switching valve 33 is in a first position shown in FIG. 2, the space S4 is in fluid communication with the cruciform grooves 43 through the first through-hole 34 and in fluid communication with the seal space S5 through the second through-hole 35. When the switching valve 33 is in a second position shown in FIG. 3, the space S4 is only in fluid communication with the cruciform grooves 43 through the first through-hole 34.

The switching valve 33 includes a first O-ring 36 for constantly sealing communication between the first through-hole 34 and external air, and a second O-ring 37 for sealing or opening communication between the space S4 and the second through-hole 35 as the switching valve 33 is moved left and right in the drawings. A spring 38 is interposed between a bottom of the first section 26A1 and the switching valve 33 in the valve chamber S6 for urging the switching valve 33 rearward in FIG. 2.

A through-hole 33*b* is formed in the switching valve 33, and a knob 39 is inserted into the through-hole 33*b*. The knob 39 is rotated to move the switching valve 33 in the front-to-rear direction. A tapered surface 33*a* is formed on the rear end of the switching valve 33 and engages with a pin 40 protruding at a position eccentric to the rotational axis of the knob 39. Since a position at which the pin 40 engages the tapered surface 33*a* changes as the knob 39 is rotated, the switching valve 33 is moved in the front-to-rear direction (between the first position shown in FIG. 2 and the second position shown in FIG. 3) as the knob 39 is rotated.

FIG. 2 shows a first state of the pressure changing mechanism 3 when the knob 39 has moved the switching valve 33 forward. In the first state, the first and second through-holes 34 and 35 are in fluid communication with each other. Further, a force acting on the piston 27 for moving the piston 27 rearward includes both the biasing force of the first spring 28 and the force of compressed air introduced from the compressed air chamber S1 into the seal space S5 via the cruciform grooves 43 and the first and second through-holes 34 and 35. Therefore, a first setting pressure of the pressure reduction valve 26 is set to a high pressure. Specifically, the valve head 29 closes the through-hole 31 when a force by the pressure P1 of compressed air applied to the first pressure receiving surface 27A of the piston 27 having a surface area SA is equivalent to a force by a pressure P1 of compressed air applied to the second pressure receiving surface 27B of the piston 27 having a surface area SB and the biasing force F of the first spring 28 ($SA \times P1 = SB \times P1 + F$). Thus, a pressure level in the compressed air chamber S1 is maintained by the pressure reduction valve 26. Since the pressure P1 of compressed air is applied to both the first and second pressure receiving surfaces 27A and 27B of the piston 27, this case can be considered equivalent to the case in which the pressure receiving surface area of the piston 27 is decreased. With this construction, it is possible to vary the pressure receiving surface area of the piston 27. More specifically, it is possible to vary the effective pressure receiving surface area for moving the piston 27 forward in FIG. 2 against the biasing force of the first spring 28. At this time, the first setting pressure in the screw driver 1 (pressure level of the compressed air chamber S1) is normally about 8 atm.

If the pressure in the compressed air chamber S1 is lowered, the piston 27 is moved toward the air plug 4 by the biasing force of the first spring 28. As a result, the valve head 29 opens the through-hole 31. Thus, a new compressed air can be introduced into the compressed air chamber S1 through the pressure reduction valve 26. In this way, the pressure in the compressed air chamber S1 can be maintained at the first setting pressure lower than the pressure level in the air plug 4.

FIG. 3 shows a second state of the pressure changing mechanism 3 when the switching valve 33 has been moved rearward by rotating the knob 39 180° from the first state shown in FIG. 2. In the second state, the second O-ring 37 of the switching valve 33 seals communication between the first and second through-holes 34 and 35, while simultaneously allowing communication between the seal space S5 and the external air. Since only the biasing force of the first spring 28 is applied to the piston 27 for moving the piston 27 rearward at this time, a second setting pressure of the pressure reduction valve 26 is lower than the first setting pressure of the state shown in FIG. 2. Specifically, the valve head 29 closes the through-hole 31 when the force by the pressure P1 of compressed air applied to the first pressure receiving surface 27A of the piston 27 having a surface area SA is equivalent to the biasing force F of the first spring 28 (SA×P1=F). At this time, the second setting pressure in the screw driver 1 (pressure level of the compressed air chamber S1) is normally about 5 atm.

With the first embodiment described above, the effective pressure receiving surface area of the piston 27 can be varied through a simple operation of rotating the knob 39 180° (a half rotation). In this way, the setting pressure in the compressed air chamber S1 can easily be changed in two stages (first and second setting pressure), thereby improving operability for instantaneously switching the setting pressure to a pressure suitable for different types of workpieces.

Next, a pneumatically operated power tool according to a second embodiment of the present invention will be described with reference to FIGS. 4 and 5.

Figure 4:
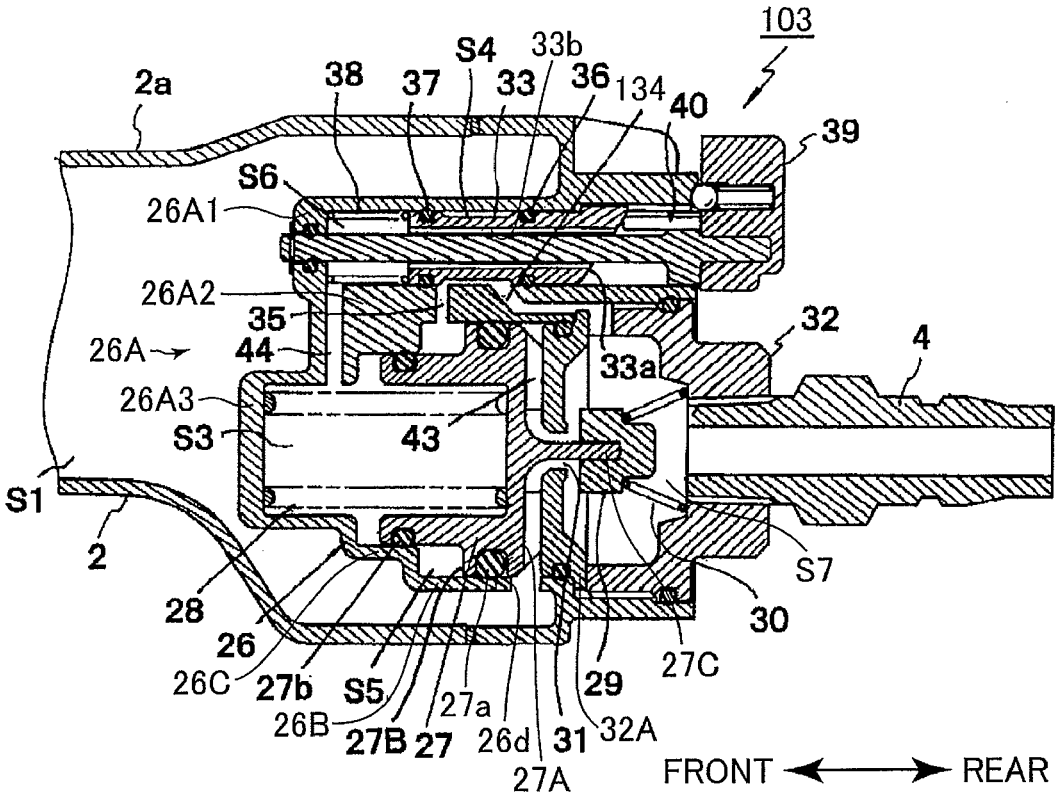
FIG. 4 is a cross-sectional view of a pressure changing mechanism provided in the screw driver according to a second embodiment of the present invention when the switching valve is in the first position.
Figure 5:
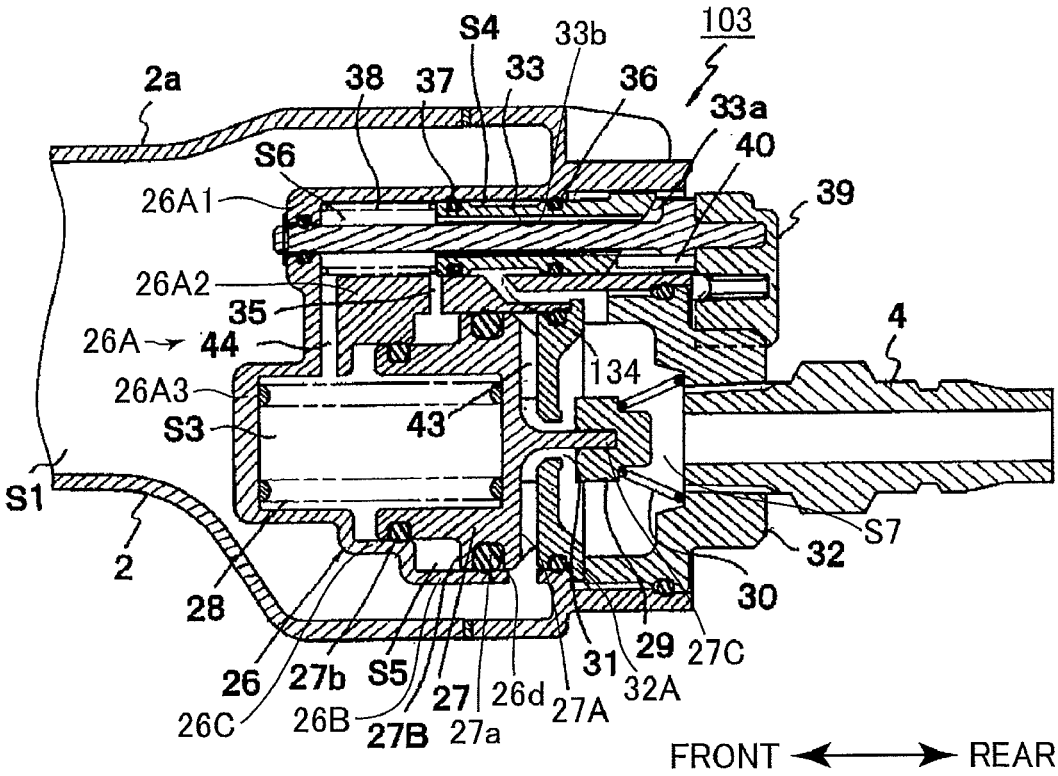
FIG. 5 is a cross-sectional view of a pressure changing mechanism provided in the screw driver according to the second embodiment when the switching valve is in the second position.

FIGS. 4 and 5 are cross-sectional views of the pressure changing mechanism 103 provided in a screw driver according to the second embodiment, wherein like parts and components are designated with the same reference numerals to avoid duplicating description.

A feature of the second embodiment is that a first through-hole 134 is in communication with the compressed air injection chamber S7 rather than the compressed air chamber S1 (cruciform grooves 43). The remaining structure is identical to that of the first embodiment shown in FIGS. 2 and 3.

FIG. 4 shows a third state of the pressure changing mechanism 103 when the knob 39 has moved the switching valve 33 forward to allow communication between the first and second through-holes 134 and 35. In the third state, a force acting on the piston 27 for moving the piston 27 rearward includes both the biasing force of the first spring 28 and the force of pressure compressed air introduced from the compressed air injection chamber S7 into the seal space S5 through the first and second through-holes 134 and 35. Therefore, a third setting pressure of the pressure reduction valve 26 is set to a high pressure. Specifically, the valve head 29 closes the through-hole 31 when a force by a pressure P2 of compressed air applied to the first pressure receiving surface 27A of the piston 27 having the surface area SA is equivalent to the biasing force F of the first spring 28 and a force by the pressure P2 of compressed air applied to the second pressure receiving surface 27B of the piston 27 having the surface area SB (SA×P2=SB×P2+F). Accordingly, the pressure level in the compressed air chamber S1 does not exceed the setting pressure (8 atm, for example).

FIG. 5 shows a fourth state of the pressure changing mechanism 103 when the switching valve 33 has been moved rearward by rotating the knob 39 180° from the third state shown in FIG. 4. In the fourth state, the second O-ring 37 of the switching valve 33 seals communication between the first and second through-holes 134 and 35, while simultaneously allowing communication between the seal space S5 and the external air. Since only the biasing force of the first spring 28 is applied to the piston 27 for moving the piston 27 rearward, a fourth setting pressure of the pressure reduction valve 26 is lower than the third setting pressure of the state shown in FIG. 4. Specifically, the valve head 29 closes the through-hole 31 when a force by the pressure P2 of compressed air applied to the first pressure receiving surface 27A of the piston 27 having the surface area SA is equivalent to the biasing force F of the first spring 28 (SA×P2=F). Hence, the pressure level in the compressed air chamber S1 does not exceed the set pressure (5 atm, for example).

In the second embodiment described above, the setting pressure in the compressed air chamber S1 can easily be changed in two stages (third and fourth setting pressure) through the simple operation of rotating the knob 39 180° (a half turn), thereby improving operability for instantaneously switching the setting pressure to a pressure suited to the type of workpiece.

Figure 6:
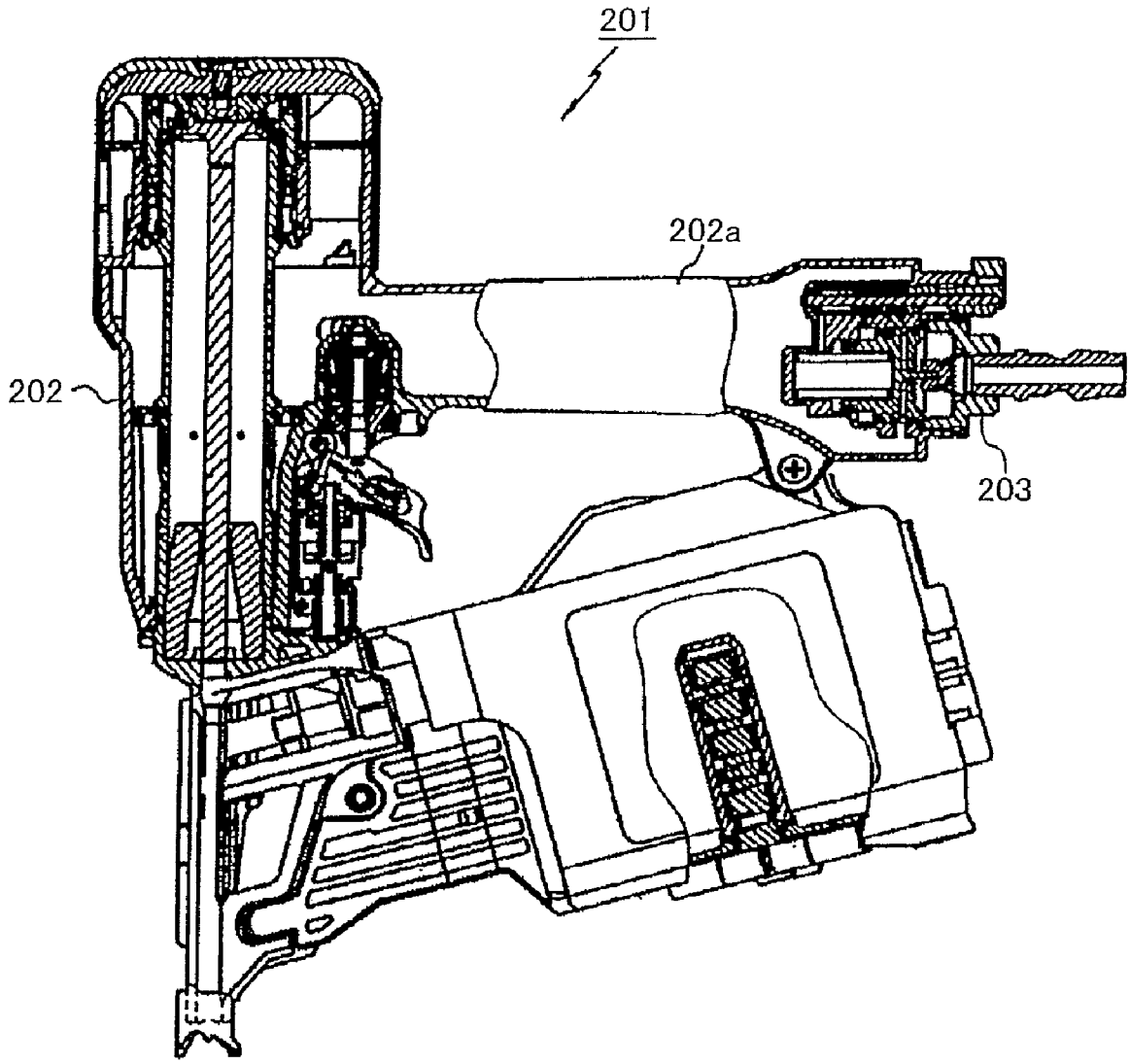
FIG. 6 is a cross-sectional view of a nail gun according to a variation of the present invention.
Figure 7:
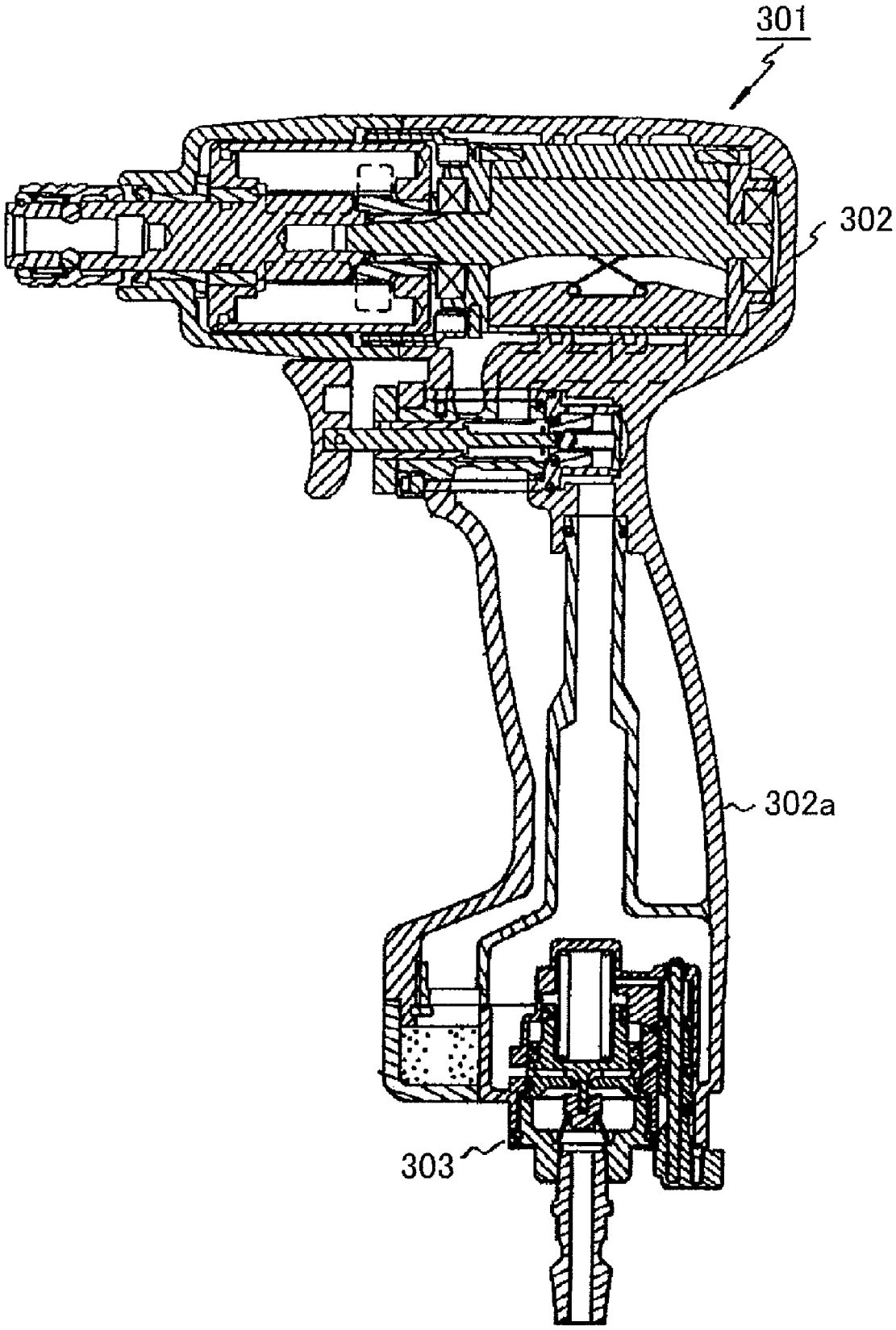
FIG. 7 is a side cross-sectional view of an impact driver according to another variation of the present invention.

While the invention has been described in detail with reference to specific embodiments thereof, it would be apparent to those skilled in the art that many modifications and variations may be made therein without departing from the spirit of the invention, the scope of which is defined by the attached claims. For example, it should be apparent that the present invention can similarly be applied to another type of pneumatically operated power tool other than the screw driver, such as a nail gun 201 shown in FIG. 6 and an impact driver 301 shown in FIG. 7. In either variation, the pressure changing mechanisms 203 and 303 are mounted on one ends of the handles 202*a* and 302*a* of the outer frames 202 and 302, respectively.

What is claimed is:

1. A pneumatically operated power tool comprising:

an outer frame having a compressed air intake portion and defining therein a compressed air chamber;

driving components disposed in the outer frame and driven by a compressed air in the compressed air chamber;

a pressure reduction valve defining a pressure receiving space and allowing a compressed air to flow from the air intake portion to the compressed air chamber and to the pressure receiving space; and a switching valve movable between a first position where the compressed air flows from the compressed air intake portion to the pressure receiving space, and a second position where a communication between the compressed air intake portion and the pressure receiving space is blocked, the pressure reduction valve being configured to set a compressed air pressure in the compressed air chamber to a first pressure level if the switching valve is located at the first position and to set the compressed air pressure to a second pressure level lower than the first pressure level if the switching valve is located at the second position;

wherein the pressure reduction valve comprises:

a first cylinder section disposed in the compressed air chamber and having a first wall and second wall, an inner diameter of the first wall is larger than an inner diameter of the second wall;

a piston disposed in the first cylinder section having a first seal member and a second seal member, an outer diameter of the first seal member is larger than an outer diameter of the second seal member; and wherein the first wall, the second wall, the first seal member, the second seal member, and the piston define the pressure receiving space.

2. The pneumatically operated power tool as claimed in claim 1, wherein the piston has a first pressure receiving surface facing the compressed air intake portion and a second pressure receiving surface defining a part of the pressure receiving space and being parallel to the first receiving surface, the piston being slidingly movable relative to the first cylinder section in a direction perpendicular to the first pressure receiving surface, the first pressure receiving surface being configured to move the piston toward a direction opposite to the compressed air intake portion by receiving the compressed air pressure, the second pressure receiving surface being configured to move the piston toward the compressed air intake portion by receiving the compressed air pressure;

a first biasing member disposed between the cylinder section and the piston for urging the piston toward the compressed air intake portion; and a valve section movable integrally with the piston for selectively blocking a fluid communication between the compressed air intake portion and the compressed air chamber.

3. The pneumatically operated power tool as claimed in claim 2, wherein the first cylinder section has a first closed bottom and a first open end, and wherein the valve section comprises a valve stem extending from the piston, and a valve head fixed to the valve stem; and the pressure reduction valve further comprising a holder section disposed at the first open end and formed with an opening for allowing the valve stem to extend therethrough, the valve head selectively closing the opening, the first pressure receiving surface being formed with a groove facing the holder section in communication with the opening and the compressed air chamber.

4. The pneumatically operated power tool as claimed in claim 1, further comprising:

a second cylinder section accommodating the switching valve therein and having a second closed bottom and a second open end;

a second biasing member disposed between the closed bottom and the switching valve for urging the switching valve toward the second open end;

a knob portion rotatably disposed on the second open end and defining a rotational axis; and a pin protruding from the knob portion at a position eccentric to the rotational axis, wherein the switching valve having a tapered surface slanting with respect to the rotational axis, the pin constantly contacting with the tapered surface by the second biasing member, the switching valve being movable between the first position and the second position by rotating the knob portion to change a position at which the pin contacts with the tapered surface.

5. A pressure changing mechanism in a pneumatically operated power tool including an outer frame having a compressed air intake portion and defining therein a compressed air chamber, and driving components disposed in the outer frame and driven by a compressed air in the compressed air chamber, the pressure changing mechanism comprising:

a pressure reduction valve defining a pressure receiving space and allowing a compressed air to flow from the air intake portion to the compressed air chamber and to the pressure receiving space; and a switching valve movable between a first position where the compressed air flows from the compressed air intake portion to the pressure receiving space, and a second position where a communication between the compressed air intake portion and the pressure receiving space is blocked, the pressure reduction valve being configured to set a compressed air pressure in the compressed air chamber to a first pressure level if the switching valve is located at the first position and to set the compressed air pressure to a second pressure level lower than the first pressure level if the switching valve is located at the second position;

wherein the pressure reduction valve comprises:

a first cylinder section disposed in the compressed air chamber and having a first wall and second wall, an inner diameter of the first wall is larger than an inner diameter of the second wall;

a piston disposed in the first cylinder section having a first seal member and a second seal member, an outer diameter of the first seal member is larger than an outer diameter of the second seal member; and wherein the first wall, the second wall, the first seal member, the second seal member, and the piston define the pressure receiving space.

6. The pressure changing mechanism as claimed in claim 5, wherein the piston has a first pressure receiving surface facing the compressed air intake portion and a second pressure receiving surface defining a part of the pressure receiving space and being parallel to the first receiving surface, the piston being slidingly movable relative to the first cylinder section in a direction perpendicular to the first pressure receiving surface, the first pressure receiving surface being configured to move the piston toward a direction opposite to the compressed air intake portion by receiving the compressed air pressure, the second pressure receiving surface being configured to move the piston toward the compressed air intake portion by receiving the compressed air pressure;

a first biasing member disposed between the cylinder section and the piston for urging the piston toward the compressed air intake portion; and a valve section movable integrally with the piston for selectively blocking a fluid communication between the compressed air intake portion and the compressed air chamber.

7. The pressure changing mechanism as claimed in claim 6, wherein the first cylinder section has a first closed bottom and a first open end, and wherein the valve section comprises a valve stem extending from the piston, and a valve head fixed to the valve stem; and the pressure reduction valve further comprising a holder section disposed at the first open end and formed with an opening for allowing the valve stem to extend therethrough, the valve head selectively closing the opening, the first pressure receiving surface being formed with a groove facing the holder section in communication with the opening and the compressed air chamber.

8. The pressure changing mechanism as claimed in claim 5, further comprising:

a second cylinder section accommodating the switching valve therein and having a second closed bottom and a second open end;

a second biasing member disposed between the closed bottom and the switching valve for urging the switching valve toward the second open end;

a knob portion rotatably disposed on the second open end and defining a rotational axis; and a pin protruding from the knob portion at a position eccentric to the rotational axis, wherein the switching valve having a tapered surface slanting with respect to the rotational axis, the pin constantly contacting with the tapered surface by the second biasing member, the switching valve being movable between the first position and the second position by rotating the knob portion to change a position at which the pin contacts with the tapered surface.

* * * * *